US007243608B2

(12) United States Patent
Knight, Jr. et al.

(10) Patent No.: US 7,243,608 B2
(45) Date of Patent: Jul. 17, 2007

(54) METHODS AND APPARATUS FOR ASSEMBLING DOCKS

(75) Inventors: Ernest Edward Knight, Jr., Wildwood, MO (US); Larry D. Moody, Monett, MO (US)

(73) Assignee: E-Z-Dock, Inc., Monett, MO (US)

( * ) Notice: Subject to any disclaimer, the term of this patent is extended or adjusted under 35 U.S.C. 154(b) by 0 days.

(21) Appl. No.: 11/024,056

(22) Filed: Dec. 22, 2004

(65) Prior Publication Data

US 2006/0130730 A1 Jun. 22, 2006

(51) Int. Cl.
*B63B 35/44* (2006.01)

(52) U.S. Cl. ..... 114/267; 114/263

(58) Field of Classification Search ..... 114/267, 114/266

See application file for complete search history.

(56) References Cited

U.S. PATENT DOCUMENTS 886,077 A 4/1908 Rowe
2,792,164 A 5/1957 Cauffiel
3,561,375 A 2/1971 Hammond
3,654,885 A 4/1972 Godbersen
3,752,102 A 8/1973 Shuman
3,780,686 A 12/1973 Brill
3,824,644 A 7/1974 Stranzinger
3,869,532 A 3/1975 Shirrell
3,964,221 A 6/1976 Berquist
4,008,506 A 2/1977 Smith
4,043,287 A 8/1977 Shorter, Jr.
4,070,980 A 1/1978 Shorter, Jr.
4,365,577 A 12/1982 Heinrich
4,418,634 A 12/1983 Gerbus
4,474,504 A * 10/1984 Whitman et al. ..... 405/16
4,543,903 A 10/1985 Kramer
4,604,962 A 8/1986 Guibault
4,655,156 A * 4/1987 Svirklys et al. ..... 114/266
4,660,495 A 4/1987 Thompson
4,768,456 A 9/1988 Jones et al.
4,799,445 A 1/1989 Meriwether
4,852,509 A 8/1989 Fransen et al.
4,860,952 A 8/1989 Schmidt
4,886,276 A 12/1989 Digangi et al.

(Continued)

FOREIGN PATENT DOCUMENTS

DE 1534368 5/1969

(Continued)

*Primary Examiner*—Jesús D. Sotelo
(74) *Attorney, Agent, or Firm*—Polster, Lieder, Woodruff & Lucchesi, L.C.

(57) ABSTRACT

A method of assembling a dock is provided. The method includes positioning a first dock module adjacent a second dock module wherein each dock module includes a top surface, a bottom surface, and a plurality of sidewalls extending therebetween. Each top surface includes at least one channel extending between opposed sidewalls, each bottom surface includes at least one pocket therein, and each sidewall includes at least one coupling slot extending from the top surface. A first coupling slot of the first dock module is substantially aligned with a first coupling slot of the second dock module. The method also includes inserting a first coupler into the first coupling slot of the first dock module and into the first coupling slot of the second dock module such that the dock modules are secured to one another.

37 Claims, 4 Drawing Sheets

U.S. PATENT DOCUMENTS 4,928,617 A 5/1990 Meriwether
4,938,629 A 7/1990 Boudrias
4,955,311 A 9/1990 Barber
4,962,716 A 10/1990 Fransen et al.
4,974,538 A 12/1990 Meriwether
5,125,355 A 6/1992 Stranzinger
5,201,467 A 4/1993 Kennel et al.
5,281,055 A * 1/1994 Neitzke et al. ..... 405/219
5,460,114 A * 10/1995 McMillan ..... 114/267
6,179,525 B1 * 1/2001 Gruhn et al. ..... 405/219

FOREIGN PATENT DOCUMENTS

FR 1232881 10/1960
GB 1058586 2/1967
WO 8803107 5/1988

* cited by examiner

METHODS AND APPARATUS FOR ASSEMBLING DOCKS

BACKGROUND OF THE INVENTION

This invention relates generally to floating docks, and more particularly, to methods and apparatus for assembling floating docks.

Floating docks are generally known and may be constructed from a variety of materials and formed into a variety of shapes and sizes. At least some known floating docks include a plurality of floating members coupled together to form the floating dock. Generally, the floating members are designed to withstand a variety of environment and weather conditions. More specifically, within at least some known floating members, pockets or cavities are defined that facilitate increasing the buoyancy of the dock, and thus facilitate maintaining the dock afloat. However, because pockets or cavities rely on trapped air, catastrophic events, for example, a collision with the dock, may rupture the pockets and submerge the dock.

At least some known floating docks have coupling systems that enable multiple configurations of the floating members to be assembled such that the dock can accommodate a variety of boat sizes and other uses. Generally, such coupling systems include couplers designed to facilitate ease of assembly and disassembly of floating members, and coupler receivers or sockets designed to receive a variety of couplers and dock accessories. More specifically, within at least some known coupling systems, the couplers include multiple components. Although the couplers generally ensure the floating members remain connected, couplers that include multiple components may increase the assembly time of the docks and may reduce the reliability of the entire dock system.

Accordingly, it would be desirable to have a docking system that would allow the user to choose multiple configurations and was simple to assemble and disassemble. Moreover, it would be desirable to have a docking system that was cost-effective to maintain and reliable in variety of environmental and catastrophic events.

BRIEF DESCRIPTION OF THE INVENTION

In one aspect, a method of assembling a dock is provided. The method includes positioning a first dock module adjacent a second dock module wherein each dock module includes a top surface, a bottom surface, and a plurality of sidewalls extending therebetween. Each top surface includes at least one channel extending between opposed sidewalls, each bottom surface includes at least one pocket therein, and each sidewall includes at least one coupling slot extending from the top surface. A first coupling slot of the first dock module is substantially aligned with a first coupling slot of the second dock module. The method also includes inserting a first coupler into the first coupling slot of the first dock module and into the first coupling slot of the second dock module such that the dock modules are secured to one another.

In another aspect, a modular dock system is provided. The modular dock system includes at least two dock modules, each dock module includes a top surface and a bottom surface coupled together by a plurality of sidewalls extending therebetween. Each top surface includes at least one channel extending between opposed sidewalls, each bottom surface includes at least one pocket formed therein. Each sidewall includes at least one coupling slot extending from the top surface towards the bottom surface. At least one coupler is configured to be attached to at least one of the coupling slots, each coupler includes at least one end section and a center section extending from the at least one end section.

In another aspect, a floating dock module is provided. The floating dock module includes a top surface, a bottom surface, and a plurality of sidewalls extending therebetween. Each top surface includes at least one channel extending between opposed sidewalls. Each bottom surface includes at least one pocket formed therein. Each sidewall includes at least one coupling slot extending from the top surface towards the bottom surface.

In a further aspect, a coupler for a modular dock system is provided. The coupler includes a unitary body including at least one end section and a center section, and a top plate coupled to the at least one end section.

DETAILED DESCRIPTION OF THE INVENTION

Figure 1:
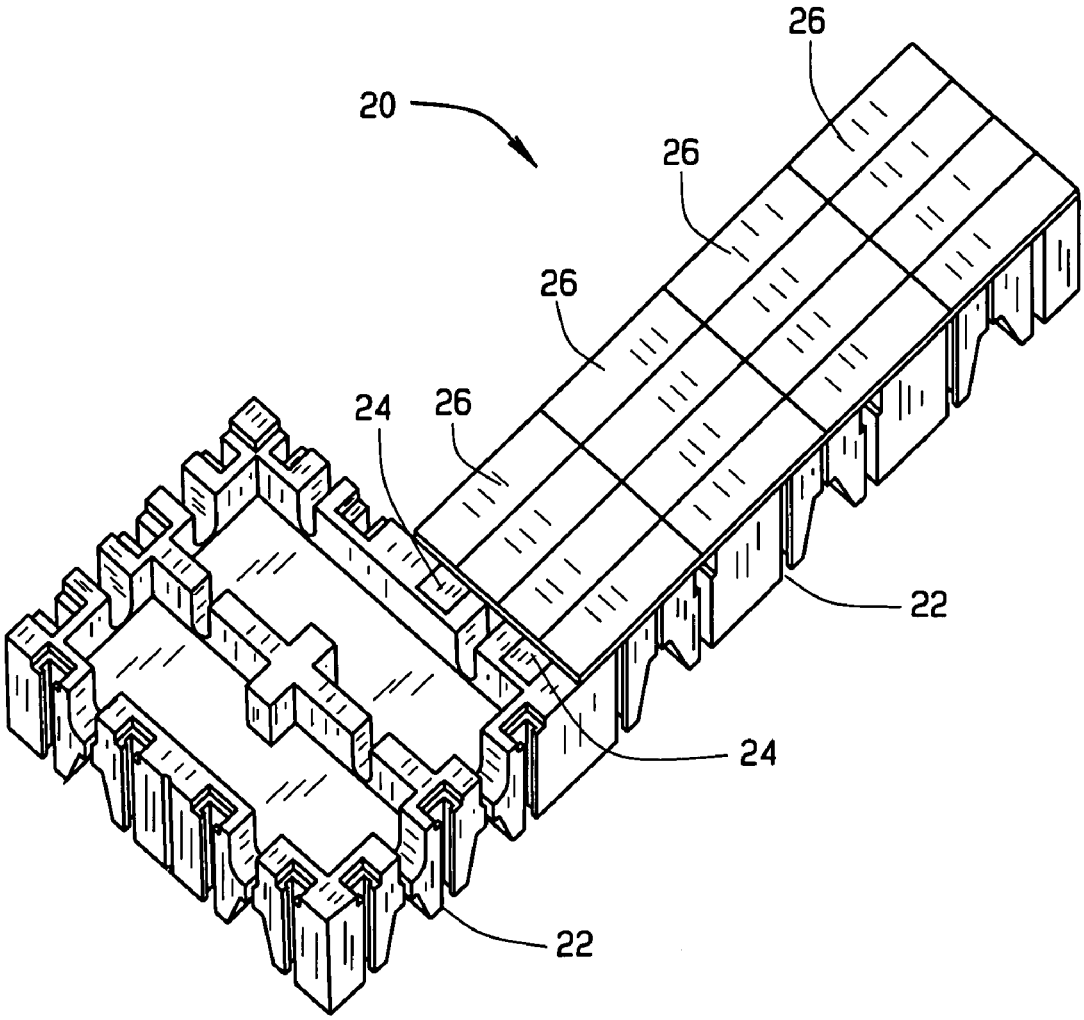
FIG. 1 is a perspective view of an exemplary modular dock system.

FIG. 1 is a perspective view of a modular dock system 20. In the exemplary embodiment, dock system 20 includes a plurality of dock modules 22 coupled together by a plurality of dock module couplers 24. Dock modules 22 may have various shapes and sizes to facilitate assembling a customized dock system 20 having an overall desired size and shape. Additionally, a plurality of dock lids 26 overlay dock modules 22.

Figure 2:
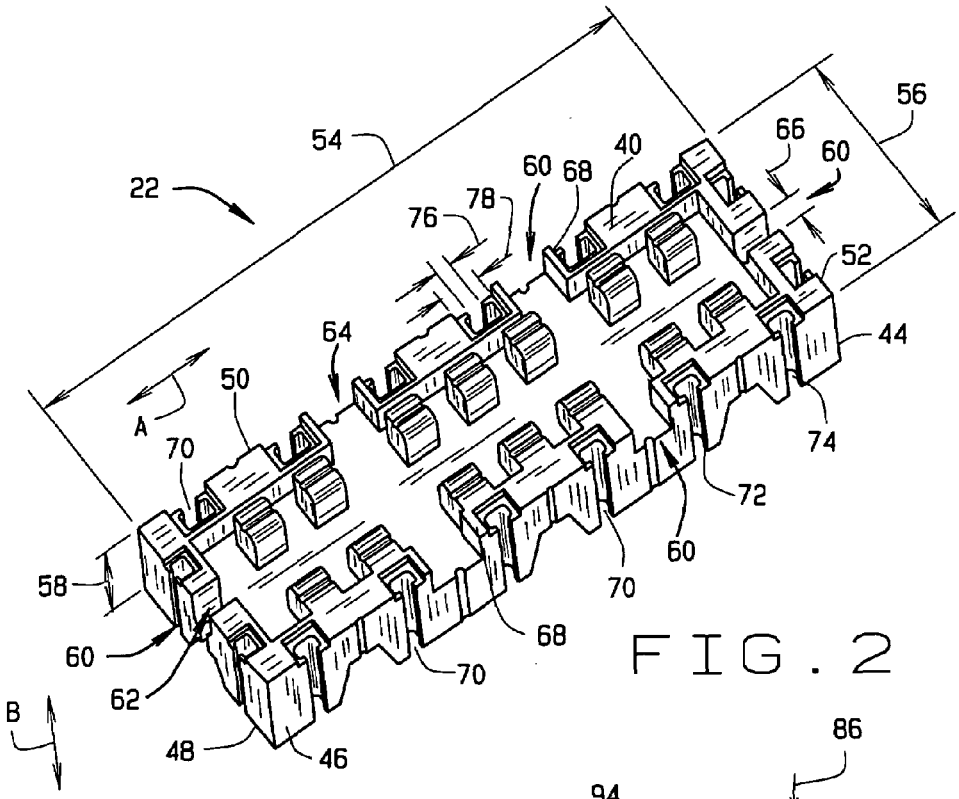
FIG. 2 is a top perspective view of an exemplary dock module used with the modular dock system shown in FIG. 1.
Figure 3:
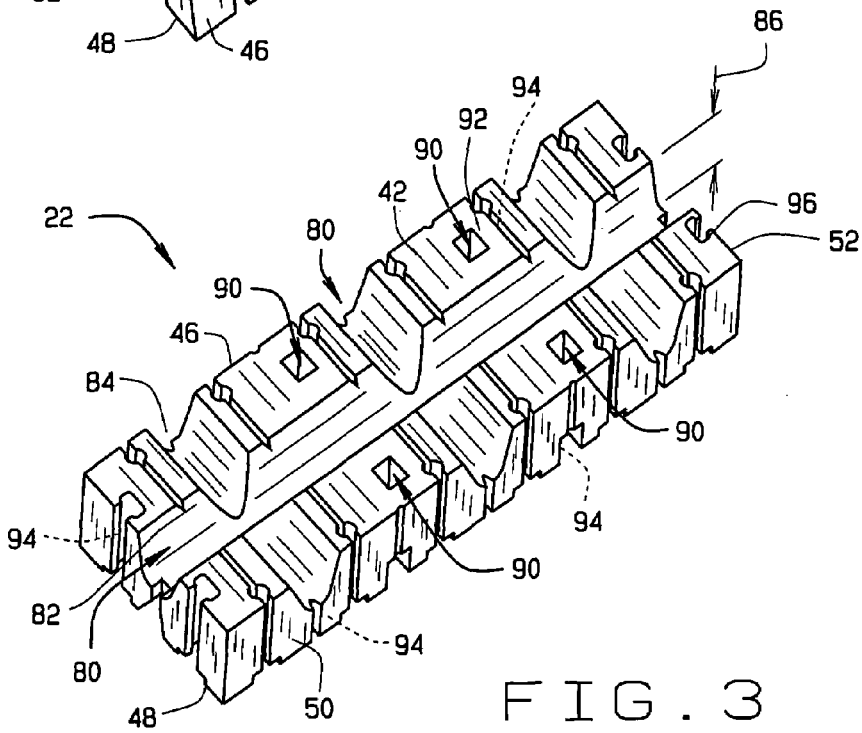
FIG. 3 is a bottom perspective view of the dock module shown in FIG. 2.

FIG. 2 is a top perspective view of a single dock module 22. FIG. 3 is a bottom perspective view of dock module 22. In the exemplary embodiment, dock module 22 is rectangular in shape. In alternative embodiments, dock module 22 may have any other shape, such as, but not limited to, a square shape, a triangular shape, or a non-orthogonal shape, such as a circular shape, or a curvilinear shape. In the exemplary embodiment, dock module 22 is fabricated from a molded polyethylene material. In alternative embodiments, dock module 22 may be fabricated from any other suitable material that enables dock module 22 to function as described herein.

In the exemplary embodiment, dock module 22 includes a top surface 40, a bottom surface 42, and a plurality of sidewalls 44 extending therebetween. Specifically, in the exemplary embodiment, dock module 22 includes a first sidewall 46, a second sidewall 48, a third sidewall 50, and a fourth sidewall 52. First and third sidewalls 46 and 50 are substantially parallel to one another, and second and fourth sidewalls 48 and 52 are substantially parallel to one another. As such, first and third sidewalls 46 and 50 are substantially perpendicular to second and fourth sidewalls 48 and 52. Sidewalls 46 and 50 have a first length 54, and sidewalls 48 and 52 have a second length 56. In the exemplary embodiment, length 54 is different than length 56. Alternatively, lengths 54 and 56 may be selected to be any length. Additionally, sidewalls 44 have a height 58. In one embodiment, first length 54 is approximately twelve feet and second length 56 is approximately four feet. In another embodiment, first length 54 is approximately eight feet and second length 56 is approximately six feet. In one embodiment, height 58 is between approximately fifteen inches and twenty-four inches. In alternative embodiments, first length 54, second length 56, and/or height 58 may be longer or shorter than the above indicated lengths and heights, depending upon the particular application.

Deck module top surface 40 includes a plurality of channels 60 extending inwardly from top surface 40. In the exemplary embodiment, channels 60 are fabricated by a molding process. Alternatively, channels 60 may be fabricated by other processes, such as, but not limited to, a forming process, a milling process, or a grinding process. In the exemplary embodiment, deck module 22 includes a longitudinal channel 62 extending from second sidewall 48 to fourth sidewall 52 and lateral channels 64 extending from first sidewall 46 to third sidewall 50. In alternative embodiments, channels 60 may not extend between respective sidewalls 44, but rather extend from only one sidewall 44, or alternatively, from neither sidewall 44. In other alternative embodiments, deck module 22 does not include longitudinal channels 62 and/or lateral channels 64. In the exemplary embodiment, channels 60 extend along a channel plane that is parallel to top surface 40 and are positioned a distance 66 from top surface 40. Channels 60 facilitate providing an area for channeling utility lines (no shown), such as, for example, electrical lines (not shown) for providing power to various portions of dock module 22, air lines (not shown) for providing compressed air to portions of dock module 22, water lines (not shown) for providing water to various portions of dock module 22, or the like.

Deck module top surface 40 includes a plurality of coupler recesses 68 extending inwardly from top surface 40. Coupler recesses 68 facilitate locating couplers, such as dock module couplers 24, with respect to dock module 22 and dock module top surface 40. In the exemplary embodiment, recesses 68 are fabricated by a molding process. Alternatively, recesses 68 may be fabricated by other processes, such as, but not limited to, a forming process, a milling process, or a grinding process.

Deck module 22 includes a plurality of coupler slots 70 extending along sidewalls 44. In the exemplary embodiment, coupler slots 70 are fabricated by a molding process. Alternatively, coupler slots 70 may be fabricated by other processes, such as, but not limited to, a forming process, a milling process, or a grinding process. In the exemplary embodiment, each coupler slot 70 extends between top and bottom surfaces 40 and 42, respectively. In an alternative embodiment, each coupler slot 70 extends from top surface 40 but does not extend to bottom surface 42. In the exemplary embodiment, each coupler slot 70 has a bulbous cross-sectional profile. Specifically, each coupler slot 70 has a necked portion 72 and a bulbed portion 74 wherein necked portion 72 has a width 76 that is less than a width 78 of bulbed portion 74. As such, when a coupler, such as dock module coupler 24 is inserted into coupler slot 70, the coupler 24 can not be removed from dock module 22 in a lateral direction, or in a direction that is transverse to a plane of sidewall 44, such as in the direction of arrow A. Rather, coupler 24 must be removed in a direction that is parallel to the plane of sidewall 44, such as in the direction of arrow B.

Dock module bottom surface 42 includes a plurality of channels 80 extending inwardly from bottom surface 42. In the exemplary embodiment, channels 80 are fabricated by a molding process. Alternatively, channels 80 may be fabricated by other processes, such as, but not limited to, a forming process, a milling process, or a grinding process. In the exemplary embodiment, deck module 22 includes a longitudinal channel 82 extending from second sidewall 48 to fourth sidewall 52 and lateral channels 84 extending from first sidewall 46 to third sidewall 50. In alternative embodiments, channels 80 may not extend between respective sidewalls 44, but rather extend from only one sidewall 44, or alternatively, from neither sidewall 44. In other alternative embodiments, deck module 22 does not include longitudinal channels 82 and/or lateral channels 84. In the exemplary embodiment, channels 80 extend along a channel plane parallel to bottom surface 42 and are positioned a distance 86 from bottom surface 42. Distance 86 is shorter than height 58. Channels 80 facilitate providing a flow through for water and debris along bottom surface 42. As such, channels 80 facilitate stabilizing dock system 20 by reducing an overall resistance of each dock module 22.

Dock module bottom surface 42 includes a plurality of pockets 90 extending inwardly from bottom surface 42. In the exemplary embodiment, each pocket 90 includes a generally inwardly sloped sidewall 92 extending from a plane defined by bottom surface 42. Pockets 90 capture ambient air therein to facilitate stabilizing dock system 20 by increasing an overall buoyancy of each dock module 22. In the exemplary embodiment, pockets 90 are fabricated by a molding process. Alternatively, pockets 90 may be fabricated by other processes, such as, but not limited to, a forming process, a milling process, or a grinding process.

Dock module 22 includes at least one inner cavity 94 defined between top and bottom surfaces 40 and 42, respectively. In one embodiment, cavity 94 is substantially filled with air to facilitate enhancing the buoyancy of dock module 22. In another exemplary embodiment, cavity 94 is substantially filled with a plurality of floatation enhancement devices 96. Each device 96 is hollow and filled with air. In one embodiment, each device 96 is spherical. Devices 96 facilitate enhancing the buoyancy of dock module 22. Additionally, in the event dock module 22 is cracked or ruptured such that cavity 94 is filled with water, flotation enhancement devices 96 will allow dock module 22 to stay afloat.

Figure 4:
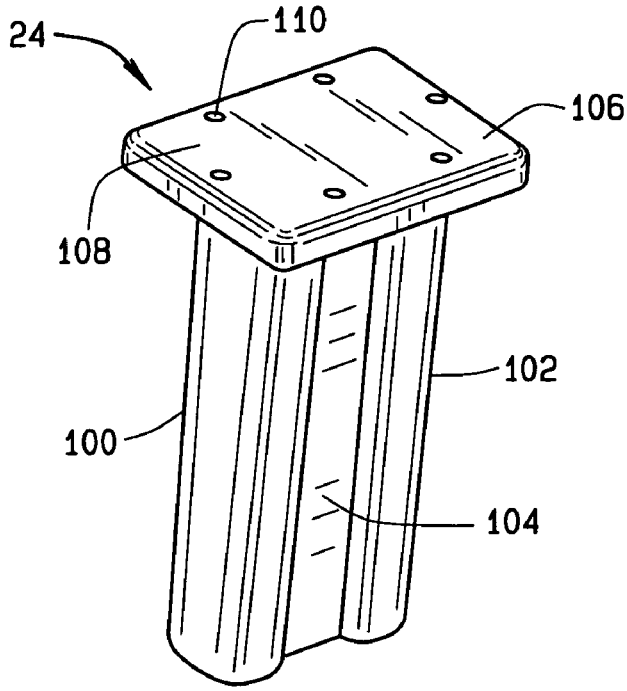
FIG. 4 is a perspective view of an exemplary coupler that may be used with the modular dock system shown in FIG. 1.

FIG. 4 is a perspective view of an exemplary dock module coupler 24. Dock module coupler 24 couples adjacent dock modules 22 (shown in FIGS. 1-3) to one another. Specifically, couplers 24 are positioned in coupler slots 70 (shown in FIGS. 2 and 3) to assemble dock system 20. More specifically, coupler slots 70 are substantially aligned with one another prior to being coupled to one another by coupler 24. Once substantially aligned, coupler 24 is inserted into coupler slots 70 of adjacent dock modules 22. In the exemplary embodiment, coupler 24 is inserted into coupler slots 70 by positioning coupler 24 substantially aligned with coupler slots 70 at top surface 40 and inserting coupler 24 into coupler slots 70 to a predetermined depth.

In the exemplary embodiment, coupler 24 is fabricated from a molded rubber material. In alternative embodiments, coupler 24 is fabricated from any other suitable material having a high strength characteristic, a low corrosion characteristic, and the like. Coupler 24 includes a first end section 100 and a second end section 102 coupled together by a center section or spacer 104. End sections 100 and 102 have a substantially circular cross sectional profile, and center section 104 has a substantially rectangular cross sectional profile. In the exemplary embodiment, end sections 100 and 102 are wider than center section 104 such that, when installed into coupler slots 70, coupler 24 is retained within coupler slots 70. In one embodiment, coupler 24 has a dog-boned cross sectional profile.

In one embodiment, coupler 24 includes a top plate 106 coupled to an end of coupler 24. In the exemplary embodiment, top plate 106 has a rectangular cross sectional profile. When installed, top plate 106 is positioned within coupler recess 68 (shown in FIG. 2) such that a top surface 108 of top plate 106 is substantially flush with dock module top surface 40 (shown in FIG. 2). In the exemplary embodiment, top plate 106 includes a plurality of fastener openings 110 for attaching couplers 24 to dock modules 22 using a fastener (not shown). Specifically, each coupler 24 is attached to respective dock modules 22 by inserting coupler 24 into respective coupler slots 70 of dock module 22 and then securing coupler to dock module 22 with the fastener. In the exemplary embodiment, coupler 24 is inserted into coupler slots 70 by positioning coupler 24 above coupler slots 70 and inserting coupler 24 into coupler slots 70 to a predetermined depth. In the exemplary embodiment, coupler 24 is inserted into each coupler slot 70 positioned along an inner perimeter of modular dock system 20 (shown in FIG. 1). In one embodiment, coupler 24 substantially fills coupler slot 70 such that coupler 24 is retained therein. Additionally, in one embodiment, a bottom surface of coupler 24 is substantially flush with dock module bottom surface 42 (shown in FIG. 3).

Figure 5:
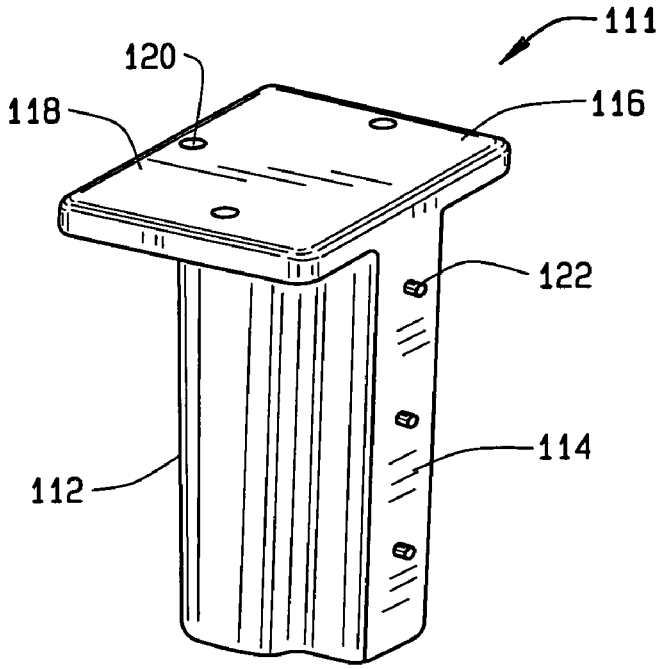
FIG. 5 is a perspective view of an alternative embodiment of an exemplary coupler that may be used with the modular dock system shown in FIG. 1.

FIG. 5 is a perspective view of a dock accessory coupler 111. In the exemplary embodiment, dock accessory coupler 111 is fabricated from a molded rubber material. In alternative embodiments, coupler 111 is fabricated from any other suitable material having a high strength characteristic, a low corrosion characteristic, and the like. Specifically, coupler 111 includes a first end section 112 and a center section 114. End section 112 has a substantially circular cross sectional profile, and center section 114 has a substantially rectangular cross sectional profile. In the exemplary embodiment, end section 112 is wider than center section 114 such that, when installed into coupler slot 70 (shown in FIGS. 2 and 3), coupler 111 is retained within coupler slots 70. In one embodiment, coupler 111 has a bulbous cross sectional profile.

In one embodiment, coupler 111 includes a top plate 116 coupled to an end of coupler 111. In the exemplary embodiment, top plate 116 has a rectangular cross sectional profile. When installed, top plate 116 is positioned within coupler recess 68 (shown in FIG. 2) such that a top surface 118 of top plate 116 is substantially flush with dock module top surface 40 (shown in FIG. 2). In the exemplary embodiment, top plate 116 includes a plurality of fastener openings 120 for attaching couplers 111 to dock modules 22 using a fastener (not shown). Specifically, each coupler 111 is attached to respective dock modules 22 by inserting coupler 111 into respective coupler slots 70 of dock module 22 and then securing coupler to dock module 22 with the fastener.

Dock accessory coupler 111 couples dock accessories (not shown), such as, but not limited to, dock bumpers, dock lights, rope, rope holders, fishing equipment, and any other suitable accessories for use with modular dock system 20. Specifically, couplers 111 include fasteners 122 extending from center section 114 to attach to any of the above mentioned dock accessories. Coupler 111 is attached to dock modules 22 by inserting coupler 111 into coupler slots 70 of dock module 22. In the exemplary embodiment, coupler 111 is inserted into coupler slots 70 by positioning coupler 111 above coupler slots 70 and inserting coupler 111 into coupler slots 70 to a predetermined depth. In the exemplary embodiment, dock accessory coupler 111 is inserted into each coupler slot 70 positioned along an outer perimeter of modular dock system 20 (shown in FIG. 1). In one embodiment, coupler 111 substantially fills coupler slot 70 such that coupler 111 is retained therein. Additionally, in one embodiment, a bottom surface of coupler 111 is substantially flush with dock module bottom surface (shown in FIG. 3).

Figure 6:
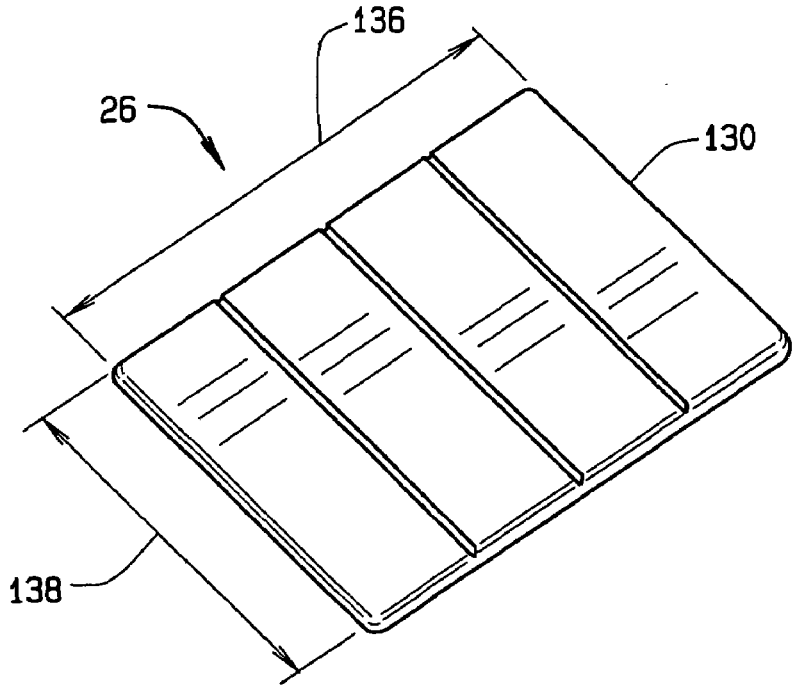
FIG. 6 is a top perspective view of an exemplary dock lid that may be used with the modular dock system shown in FIG. 1.
Figure 7:
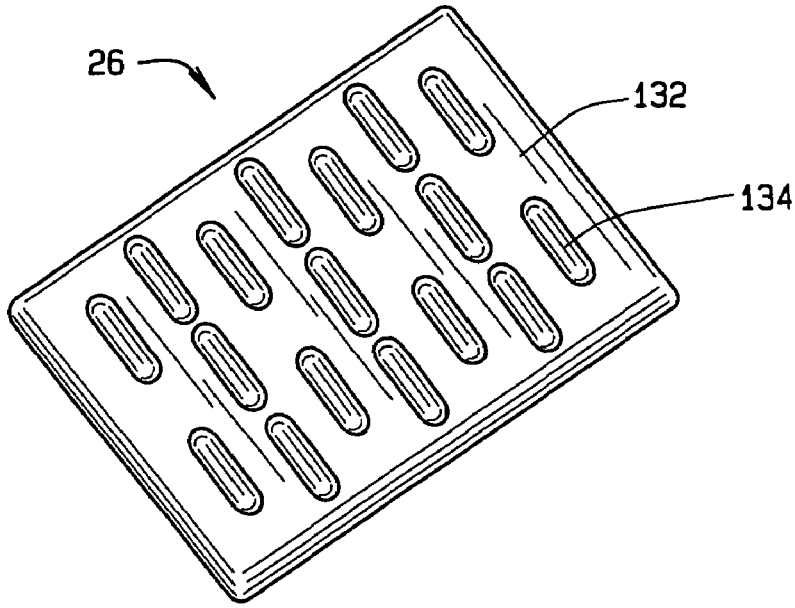
FIG. 7 is a bottom perspective view of the dock lid shown in FIG. 6.

FIG. 6 is a top perspective view of dock lid 26 for use with modular dock system 20 (shown in FIG. 1). FIG. 7 is a bottom perspective view of dock lid 26. In the exemplary embodiment, dock lid 26 is rectangular in shape. In alternative embodiments, dock lid 26 may have any other shape, such as, but not limited to, a square shape, a triangular shape, or a non-orthogonal shape, such as a circular shape, or a curvilinear shape. In the exemplary embodiment, dock lid 26 is fabricated from a molded polyethylene material. However, in alternative embodiments, dock module 22 may be fabricated from any other suitable material.

Dock lid 26 includes a top surface 130 and a bottom surface 132. In the exemplary embodiment, top surface 130 is fabricated to have a predefined concrete block pattern. In another embodiment, top surface 130 is fabricated to have a predefined pattern such as, but not limited to, a wood grain pattern, a stone pattern, a brick pattern, or any other suitable pattern. In yet another embodiment, top surface 130 is fabricated to have a raised pattern to facilitate increasing traction during inclement weather. In one embodiment, dock lids 26 are coupled to dock modules 22 by a plurality of fasteners (not shown).

A plurality of "kiss-offs" or recesses 134 are formed in bottom surface 132 to facilitate increasing an overall strength of dock lid 26 and reducing an overall weight of dock lid 26. Dock lid 26 has a length 136 and a width 138. In one embodiment, length 136 is approximately four feet and width 138 is approximately three feet. In another embodiment, length 136 is approximately equal to dock module length 54 and width 138 is approximately equal dock module width 56. In alternative embodiments, length 136 and width 138 second may be longer or shorter than the above indicated lengths and widths, depending upon the particular application.

The above described modular dock system is cost-effective and highly-reliable. The modular dock system includes a plurality of unitary dock modules each with integrally formed channels, pockets, and cavities. A plurality of unitary couplers are configured to facilitate ease of assembling and disassembling each dock module together or provide a mounting place for dock accessories. The unitary structures are cost-effective to maintain and facilitate forming a safe and reliable dock system capable of surviving a variety environmental and catastrophic events.

Exemplary embodiments of the modular dock system, specifically dock modules, couplers, and dock lids are described above in detail. Each dock module, coupler, and dock lid is not limited to the specific embodiments described herein, but rather each component may be utilized independently and separately from other components described herein. Each component can also be used in combination with other modular docking systems.

While the invention has been described in terms of various specific embodiments, those skilled in the art will recognize that the invention can be practiced with modification within the spirit and scope of the claims.

What is claimed is:

1. A modular dock system comprising:

at least two dock modules, each said dock module comprising a top surface and a bottom surface coupled together by a plurality of sidewalls extending therebetween; at least one cavity defined between said top and bottom surfaces and said plurality of sidewalls; said at least one cavity being substantially filled with at least one floatation enhancing device; and each said sidewall comprising at least one coupling slot extending from said top surface towards said bottom surface; and at least one coupler; said coupler comprising at least one end section and a spacer extending from said at least one end section; at least said coupler end section being configured to be received in at least one of said coupling slots.

2. The modular dock system of claim 1 wherein each said at least one flotation enhancing device comprises a plurality of air filled spherical devices.

3. The modular dock system of claim 1 wherein said top surface of said dock modules comprise at least one channel extending between opposed sidewalls and each said bottom surface comprising at least one pocket formed therein.

4. The modular dock system of claim 3 wherein each said pocket includes a sidewall extending from said bottom surface.

5. The modular dock system of claim 4 wherein each said pocket defines an air pocket therein to facilitate floating of said dock module.

6. A modular dock system comprising:

at least two dock modules, each said dock module comprising a top surface and a bottom surface coupled together by a plurality of sidewalls extending therebetween, each said sidewall comprising at least one coupling slot extending from said top surface towards said bottom surface;

at least one coupler configured to be received in at least one of said coupling slots of each of said dock modules to connect said dock modules together, each said coupler comprising at least one end section and a spacer extending from said at least one end section; and a dock lid secured to the top surface of each of said dock modules; said dock lid having an upper surface defining a tread surface for the dock system; said dock lids having a height substantially less than the height of said dock modules and having a size and shape in top plan corresponding generally to the size and shape of the top surface of said dock modules.

7. The modular dock system of claim 6 wherein said dock module is fabricated from a plastic material.

8. The modular dock system of claim 6 wherein said dock module comprises at least one cavity defined between said top and bottom surfaces and said plurality of sidewalls.

9. The modular dock system of claim 8 wherein said at least one cavity is substantially filled with air to facilitate increasing a floating capacity of said dock module.

10. The modular dock system of claim 6 wherein the coupling slots of adjacent dock modules are substantially aligned with each other; said at least one coupler extending between said adjacent dock modules and being received in said coupling slots of adjacent dock modules to connect adjacent dock modules together.

11. The modular dock system of claim 6 wherein each said coupling slot extends between said top surface and said bottom surface; said coupler end section having a length greater than one-half the height of said dock section.

12. A modular dock system comprising:

at least two dock modules, each said dock module comprising a top surface and a bottom surface coupled together by a plurality of sidewalls extending therebetween, each said sidewall comprising at least one coupling slot extending from said top surface towards said bottom surface; and at least one coupler configured to be received in at least one of said coupling slots, each said coupler comprising an elongate first end section, an elongate second end section, and a center section extending between said first and second sections; said first and second sections having a length greater than one-half the height of said dock modules; said first end section being received in a slot of said first dock module, said second end section being received in a slot of a second dock module, said coupler extending between said top surface and said bottom surface.

13. The modular dock system of claim 12 wherein each said coupler is unitary.

14. The modular dock system of claim 12 wherein each said coupler is received in at least one of said coupling slots through said top surface of said dock module.

15. The modular dock system of claim 12 wherein each said coupler further comprises a top plate, said top plate facilitates orienting said coupler at a predetermined depth within at least one of said coupling slots.

16. A modular dock system comprising:

at least two dock modules, each said dock module comprising a top surface and a bottom surface coupled together by a plurality of sidewalls extending therebetween, each said sidewall comprising at least one coupling slot extending from said top surface towards said bottom surface;

at least one coupler configured to be received in at least one of said coupling slots, each said coupler comprising at least one end section and a spacer extending from said at least one end section; and at least one fastening mechanism extending from said coupler, said at least one fastening mechanism extending from said spacer opposite said end section.

17. A modular dock system comprising:

at least two dock modules; each said dock module comprising a top surface and a bottom surface coupled together by a plurality of sidewalls extending therebetween; each said top surface comprising at least one channel extending between opposed sidewalls; each said bottom surface comprising at least one pocket formed therein; and each said sidewall comprising at least one coupling slot extending from said top surface towards said bottom surface;

at least one coupler configured to be received in at least one of said coupling slots, said at least one coupler comprising at least one end section, a spacer extending from said at least one end section, and a top plate; said top plate facilitating orienting of said at least one coupler at a predetermined depth within at least one of said coupling slots; and a dock lid, said dock lid configured to be secured to said coupler top plate.

18. The modular dock system of claim 17 further comprising at least one bottom channel extending along said bottom surface of said dock module between opposed sidewalls of said dock module.

19. The modular dock system of claim 18 wherein said dock module said bottom surface comprising at least one pocket formed therein; said pocket being isolated from each said channel.

20. The modular dock system of claim 18 wherein each said channel of said bottom surface channels water therethrough to facilitate stabilizing said dock module.

21. The modular dock system of claim 18 wherein said at least one channel on said bottom surface of said dock module is opened at the opposed side walls.

22. A floating dock module comprising:

a top surface, a bottom surface, and a plurality of sidewalls extending therebetween; at least one cavity defined between said top and bottom surfaces and said plurality of sidewalls; each said top surface comprising at least one channel extending between opposed sidewalls; each said bottom surface comprising at least one pocket formed therein; each said sidewall comprising at least one coupling slot extending from said top surface towards said bottom surface; said at least one cavity being substantially filled with at least one floatation enhancing device.

23. The floating dock module of claim 22 wherein each said at least one flotation enhancing device comprises an air filled spherical device.

24. In combination, a floating dock module and a dock lid;

said dock module comprising a top surface, a bottom surface, and a plurality of sidewalls extending therebetween, at least two of said sidewalls comprising at least one coupling slot extending from said top surface towards said bottom surface;

said dock lid extending along said dock module top surface; said dock having a top surface defining a tread surface; said dock lid having a height substantially shorter than the height of said dock module and having a size and shape in top plan corresponding generally to the size and shape to the top surface of said dock module.

25. The combination of claim 24 wherein said dock module is fabricated from a plastic material.

26. The combination of claim 24 wherein said dock module comprises at least one cavity defined between said top and bottom surfaces and said plurality of sidewalls.

27. The combination of claim 26 wherein said at least one cavity is substantially filled with air to facilitate increasing a floating capacity of said dock module.

28. The combination of claim 24 wherein each said coupling slot is configured to receive a coupler therein, said coupler being configured to couple together adjacent dock modules or to mount a dock module accessory on said dock module.

29. The combination of claim 24 wherein dock module comprises a pocket formed in said bottom surface of said dock module; each said pocket including a sidewall extending from said bottom surface.

30. The combination of claim 29 wherein each said pocket defines an air pocket therein to facilitate floating of said dock module.

31. The combination of claim 24 further comprising at least one bottom channel extending along said bottom surface between opposed sidewalls.

32. The combination of claim 31 wherein each said pocket is isolated from each said channel.

33. The combination of claim 31 wherein each said channel channels water therethrough to facilitate stabilizing said dock module.

34. A coupler for a modular dock system, said coupler comprising:

an elongate unitary body comprising at least one end section and a spacer extending from said end section; said coupler body having a top end, a bottom end, and a wall between said top and bottom ends; and a top plate at said coupler body top end; said top plate extending generally perpendicularly to said coupler body, and extending over both said coupler end section and said coupler spacer; said top plate defining a plate surface having a peripheral edge; said plate surface defining an plate area; said plate being sized such that said plate area is greater than an area defined by said body top end, such that said plate peripheral edge is, at least in part, spaced from said body wall to define an overhang.

35. The coupler of claim 34 wherein said at least one end section is wider than said spacer.

36. The coupler of claim 34 wherein said top plate is substantially rectangular shaped and includes a plurality of fastener openings.

37. The coupler of claim 34 wherein said coupler comprises at least one fastening mechanism extending from said spacer opposite said end section.

* * * * *